US010099763B1

(12) United States Patent
Guerette et al.

(10) Patent No.: US 10,099,763 B1
(45) Date of Patent: Oct. 16, 2018

(54) ANTIFOULING SYSTEM FOR WATER JET INTAKE

(71) Applicants: Daniel A. Guerette, Sabattus, ME (US); Joel E. Guerette, Wales, ME (US)

(72) Inventors: Daniel A. Guerette, Sabattus, ME (US); Joel E. Guerette, Wales, ME (US)

(73) Assignee: DJC MARINE TECHNOLOGIES LLC, Lewiston, ME (US)

( * ) Notice: Subject to any disclaimer, the term of this patent is extended or adjusted under 35 U.S.C. 154(b) by 391 days.

(21) Appl. No.: 15/066,398

(22) Filed: Mar. 10, 2016

(51) Int. Cl.
*B63H 11/01* (2006.01)
*B63H 11/04* (2006.01)
*F04D 29/70* (2006.01)

(52) U.S. Cl.
CPC ..... *B63H 11/01* (2013.01); *B63H 11/04* (2013.01); *F04D 29/708* (2013.01); *F05D 2250/51* (2013.01); *F05D 2260/607* (2013.01)

(58) Field of Classification Search
CPC ..... B63H 11/01; B63H 11/04; F04D 29/708; F05D 2250/51; F05D 2260/607
See application file for complete search history.

(56) References Cited

U.S. PATENT DOCUMENTS 2,690,728 A 10/1954 Cavanaugh
3,040,695 A 6/1962 Austin
3,147,733 A 9/1964 Engel
3,253,567 A 5/1966 Patton
3,367,116 A * 2/1968 Stallman ..... F01P 3/202 415/197
3,580,210 A 5/1971 Svensen
4,718,871 A 1/1988 Mendelevitch
5,577,941 A 11/1996 Chartier
5,876,258 A * 3/1999 Gray ..... B63H 5/165 440/38
7,270,583 B1 * 9/2007 Yeun-Junn ..... B63H 5/16 440/38
7,520,789 B1 * 4/2009 Carlson ..... B63H 11/01 440/46
8,007,329 B2 * 8/2011 Wengren, Jr. ..... B63H 11/01 440/46
8,070,539 B2 12/2011 Carlson

* cited by examiner

*Primary Examiner* — Ninh H. Nguyen

(74) *Attorney, Agent, or Firm* — Seth Natter; Natter & Natter

(57) ABSTRACT

A water jet intake grate mounted to an intake opening in the hull of a watercraft includes parallel stringer blades having sharp cutting edges which span between fore and aft base plates to shred water borne debris as the debris sucked through the intake opening. The base plates are anchored to the hull at opposite ends of the intake opening. A transverse knife blade having sharp cutting edges spans across the stringer blades and the aft base plate includes a transverse sharp cutting edge, both for crosscut shredding of debris. The aft base plate includes an inboard tail blade lying in a plane parallel to the stringer blades having sharp cutting edges for shredding any residual debris.

20 Claims, 4 Drawing Sheets

ANTIFOULING SYSTEM FOR WATER JET INTAKE

BACKGROUND OF THE INVENTION

1. Field of the Invention

This invention relates generally to jet watercraft and more specifically to an intake grating system which shreds water borne debris to preclude clogging the intake as well as impeller fouling.

2. Antecedents of the Invention

Jet drive systems propel watercraft by rapidly accelerating a relatively small volume of water over a distance. This is accomplished using one or more impeller stages located within the watercraft hull. The impeller includes a plurality of blades confined in a housing. Rotation of the impeller blades draws water into an intake, past the blades, and through an outlet at the stern. Improved propulsion efficiency occurs when there is a close fit between the ends of the impeller blades and the interior of the housing.

An important aspect in the effective operation of the jet drive is the availability of an adequate supply of water to be expelled from the outlet. For that reason, in general, a larger intake is desirable as it ensures a greater water supply available to the impeller to generate thrust. On the other hand, a large intake allows the impeller to draw aquatic debris in with the water. It is desirable to minimize debris contact with the impeller, which may damage the blades or clog the impeller. It is therefore critical to avoid or minimize drawing through the intake aquatic debris of a size sufficient to cause damage or fouling of the impeller while at the same time keeping the intake as open as possible.

In this regard, intake grates have been employed to catch relatively large-sized aquatic debris and prevent the debris from reaching the impeller. In relatively clear water, these grates serve their purpose adequately. In some instances, when the watercraft passed through patches of heavy aquatic debris, e.g., seaweed and eel grass, the debris clogged the grate and blocked the intake. In other instances, the aquatic debris passed through the grate and adhered to the front leading edges of the blades of the impeller. Either type of fouling resulted in a substantial reduction of thrust capability and corresponding slowing or halting movement of the watercraft. Unexpected substantial slowing or halting of the watercraft could present a safety issue for the watercraft operator and occupants, depending upon sea conditions, weather and location.

Watercraft operators have attempted to clear such fouling in several ways. One option was to reverse the direction of rotation of the impeller to expel the fouling from the grate. A further approach was to access the housing through an observation port below the deck and try to pull out any fouling. A final approach was to swim under the watercraft and pull the debris away from the grate by hand. These options were either ineffective or undesirable.

In U.S. Pat. Nos. 8,007,329 and 7,377,826, systems capable of removing debris, such as seaweed and eel grass, from an intake grate by cutting the debris into small pieces capable of passing through the impeller without affecting impeller efficiency were disclosed. The systems included a hydraulically actuated cutting blade which swept over the grate.

There was a need, however, for an intake system capable of shredding debris to a size which could pass through an impeller without employing mechanical arrangements having moving parts so that both the possibility of mechanical failure and drag would be reduced.

SUMMARY OF THE INVENTION

A water jet intake grate system for a watercraft includes a plurality of parallel sharp cutting edge stringer blades which span between fore and aft base plates to shred water borne debris in a longitudinal direction as the debris is sucked through an intake opening in the hull and toward an impeller. The base plates are anchored to the hull at opposite ends of the intake opening. A transverse knife blade spans across the stringer blades and the aft base plate includes a transverse sharp cutting edge, both for crosscut shredding of debris. The aft base plate includes inboard tail blade having cutting edges parallel to the stringer blades for shredding any residual debris pieces which might be large enough to cause fouling of the impeller.

From the foregoing compendium, it will be appreciated that a feature of the present invention is to provide an antifouling system for a water jet intake of the general character described which is not subject to the disadvantages of the aforementioned antecedents of the invention.

An aspect of the present invention is to provide an antifouling system for a water jet intake of the general character described which is effectively shreds aquatic debris for passage through an impeller without resort to moving mechanical parts.

A consideration of the present invention is to provide an antifouling system for a water jet intake of the general character described with minimal maintenance requirements.

To provide an antifouling system for a water jet intake of the general character described which easy to install is a further consideration of the present invention.

A further consideration of the present invention is to provide an antifouling system for a water jet intake of the general character described which effectively crosscut shreds aquatic weeds and grass for passage through a jet impeller.

Another feature of the present invention is to provide an antifouling system for a water jet intake of the general character described which assures that aquatic debris cannot aggregate at and clog the intake.

An additional aspect of the present invention is to provide an antifouling system for a water jet intake of the general character described which is well suited for both aftermarket and factory O.E.M. applications.

A still further consideration of the present invention is to provide an antifouling system for a water jet intake of the general character described which is operational at all times the water jet impeller is operating.

To provide an antifouling system for a water jet intake of the general character described which shreds aquatic debris to a size sufficient to pass through an impeller without fouling while at the same time maintains the intake as open as possible is a significant aspect of the present invention.

Other aspects, features and considerations of the present invention in part will be obvious and in part will be pointed out hereinafter.

With these ends in view, the invention finds embodiment in various combinations of elements, arrangements of parts and series of steps by which the above-mentioned aspects, features and considerations and certain other aspects, features and considerations are attained, with reference to the accompanying drawings and the scope of which will be more particularly pointed out and indicated in the appended claims.

BRIEF DESCRIPTION OF THE DRAWINGS

In the accompanying drawings, in which are shown an exemplary embodiment of the present invention.

DETAILED DESCRIPTION OF THE PREFERRED EMBODIMENT

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements.

Moreover, where certain elements of the present invention can be partially or fully implemented using known components, only those portions of such known components that are necessary for an understanding of the present invention will be described, and detailed descriptions of other portions of such known components will be omitted so as not to obscure the invention. In the present specification, an embodiment showing a singular component should not be considered limiting; rather, the invention is intended to encompass other embodiments including a plurality of the same component, and vice-versa, unless explicitly stated otherwise herein.

Moreover, applicants do not intend for any term in the specification or claims to be ascribed an uncommon or special meaning unless explicitly set forth as such. Further, the present invention encompasses present and future known equivalents to the known components referred to herein by way of illustration.

Figure 1:
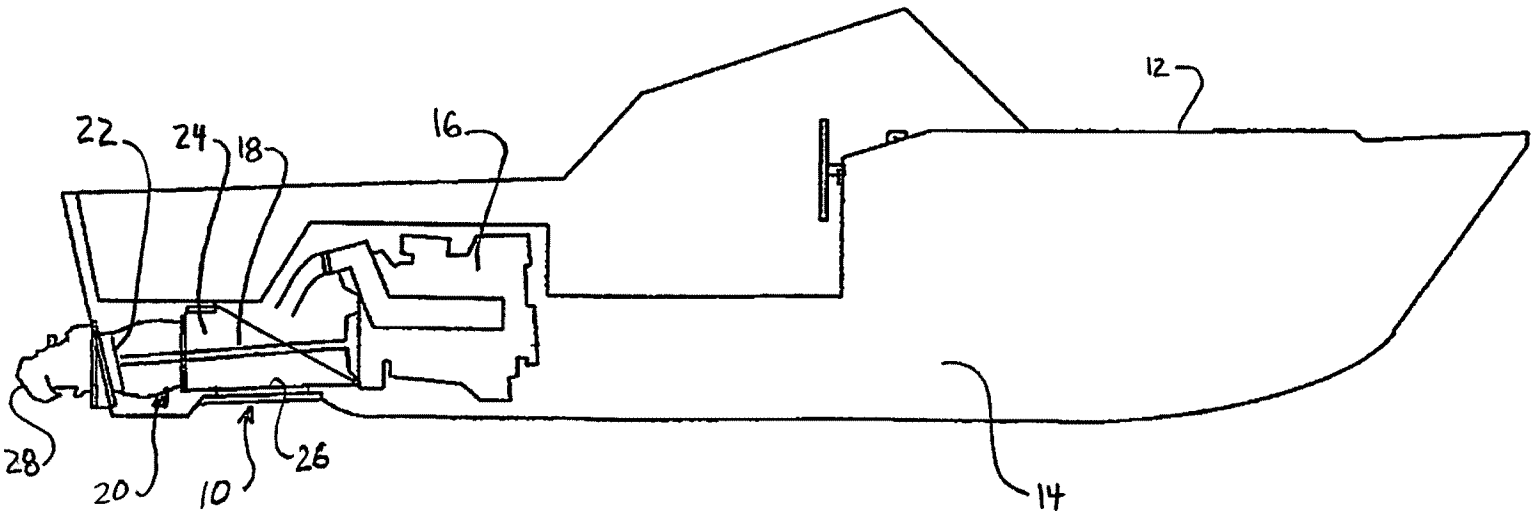
FIG. 1 is a schematized side elevation view of a water jet propelled watercraft, with portions broken away to better illustrate the operative location of an intake antifouling system constructed in accordance with the present invention.

With reference now to the drawings, wherein like numerals refer to like components throughout, the reference numeral 10 denotes generally an antifouling system for a water jet intake constructed in accordance with and embodying the present invention. In FIG. 1 the antifouling system 10 is shown mounted in operative position on a watercraft 12. It should be appreciated that the watercraft 12 includes a hull 14 and an inboard engine 16, the output of which is coupled to a driveshaft 18.

A jet drive system 20 includes one or more impellers 22, driven by the driveshaft 18 and positioned within a water jet flow path defined by a housing 24. The water jet flow path extends from an inlet 26, positioned in the hull 14, through the impeller 22 to an outlet port 28.

Figures 2, 3:
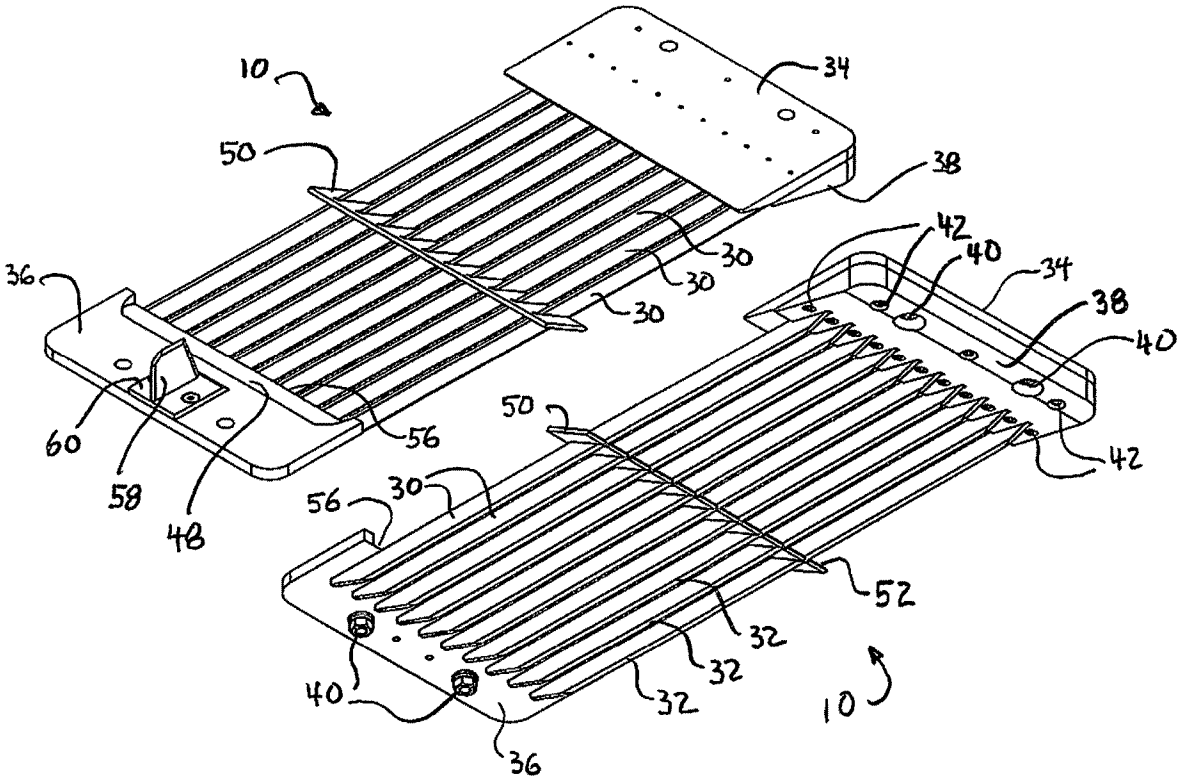
FIG. 2 is an inboard isometric view of the intake antifouling system showing a plurality of parallel stringer blades mounted between fore and aft base plates as well as a transverse knife blade and a tail blade.
FIG. 3 is an outboard isometric view of the intake antifouling system showing sharp cutting edges extending along the stringer blades and a transverse knife blade spanning across the stringer blades.

Pursuant to the invention, the antifouling system 10 is secured to the hull 14 in registration with the inlet 26, as depicted in FIG. 1. With reference to FIGS. 2, 3, 4 and 6, it should be noted that the antifouling system includes an array of parallel elongate stringer blades 30, each having a sharp cutting edge 32. From the cutting edge 32, each stringer blade 30 is of uniform thickness defined by parallel side walls. When the antifouling system 10 is mounted to the hull 14 at the inlet opening 26, oriented as depicted in FIG. 2, the sharp cutting edges 32 face in an outboard direction.

The stringer blades 30 are fixed, at one end to a fore base plate 34 and at their opposite ends to an aft base plate 36. Secured over a leading portion of the fore base plate 34 is a replaceable cap plate 38 which is slotted to overly and accommodate end portions of the stringer blades 30. The stringer blades 30, the fore base plate 34 and aft base plate 36 are preferably fabricated of stainless steel, while the replaceable cap plate 38 may be fabricated of zinc and will intentionally be prone to sacrificial galvanic corrosion or may be fabricated of a thermoplastic, such as, Delrin® acetal polyoxymethylene resin.

The ends of the stringer blades are preferably secured to the base plates 34, 36 by welds or other securement arrangement. The base plates 34, 36 are preferably secured to the hull by stainless steel bolts 40, while the replaceable cap plate 38 may be secured to the fore base plate 34 by stainless steel machine screws 42.

Figure 4:
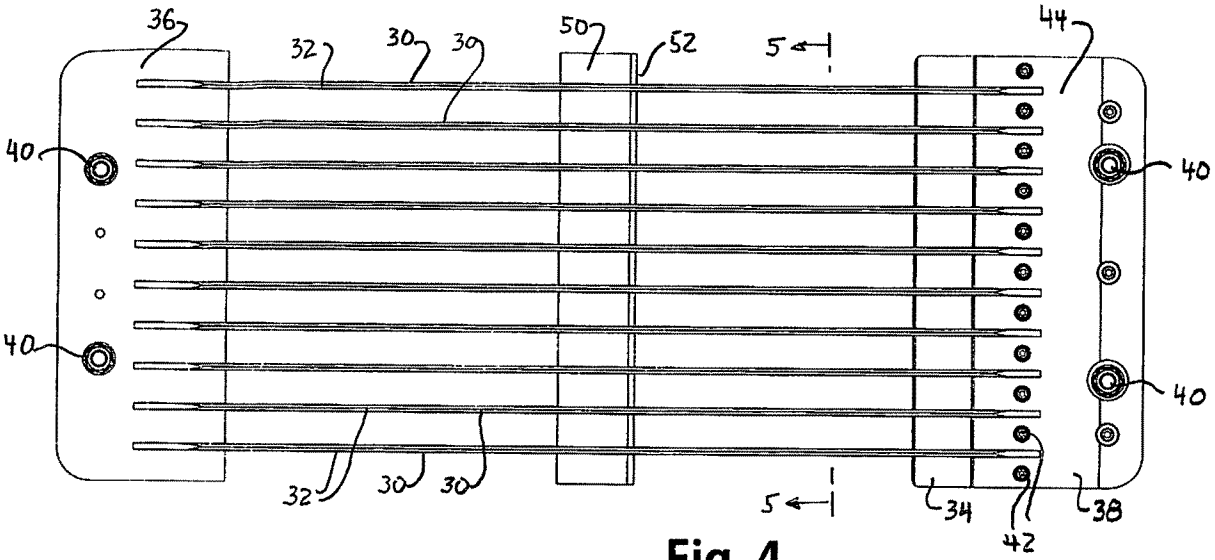
FIG. 4 is an outboard plan view of the intake antifouling system.
Figure 6:
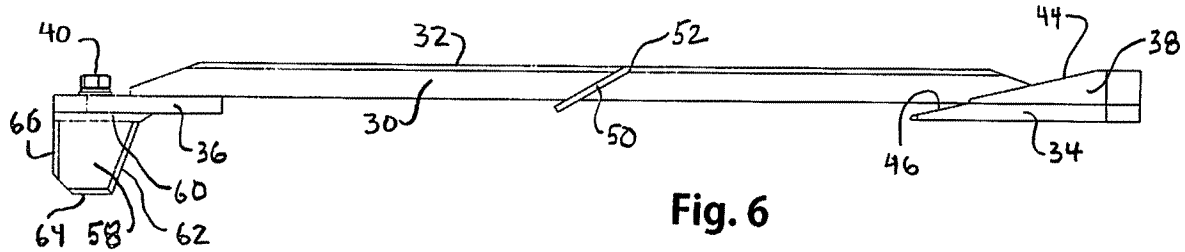
FIG. 6 is a front elevational view of the intake antifouling system as oriented in FIG. 4.
Figure 7:
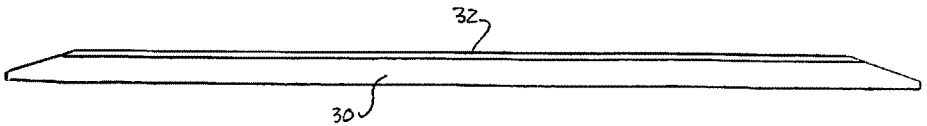
FIG. 7 is a front elevational view of a sringer blade.
Figure 5:
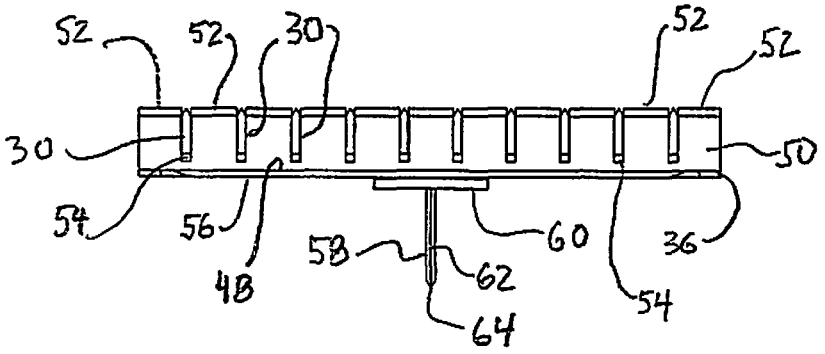
FIG. 5 is a transverse sectional view through the intake antifouling system, the same being taken substantially along the plane 5-5 of FIG. 4.
Figure 8:
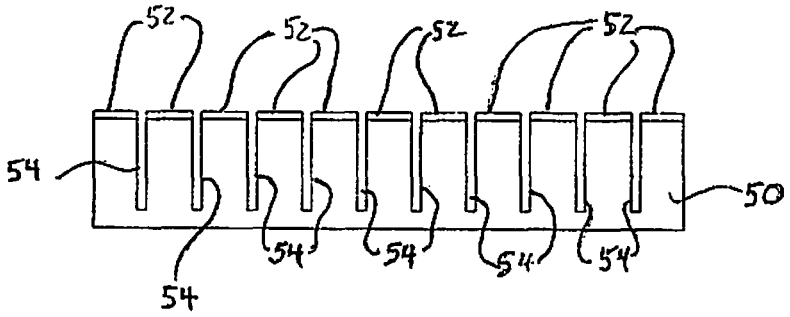
FIG. 8 is an elevational view of the transverse knife blade.
Figure 9:
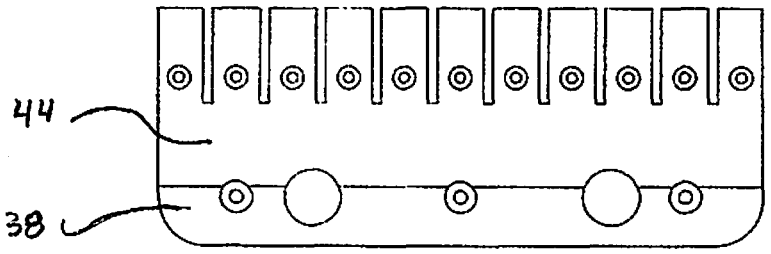
FIG. 9 is a top plan view of a cap plate which overlies the fore base plate.

With reference to FIGS. 4 and 6, it should be noted that a trailing planar portion 44 of the face of the cap plate 38 is inclined or sloped in an inbound direction at an angle of approximately 15° to facilitate water flow into the housing 24. A trailing planar portion 46 of the fore base plate 34 is also inclined in an inbound direction at an angle of approximately 15°. Illustrated in FIG. 2 is a planar cutaway portion 48 formed on the inboard face of the aft base plate 36. The cutaway portion 48 is also inclined in an inbound direction at an angle of approximately 15° to facilitate water flow into the housing 24.

A planar crosscut knife blade 50, having sharp cutting edges 52, extends transversely across the array of stringer blades 30, as depicted in FIGS. 2 through 5 and may be welded in place. The knife blade 50 includes a plurality of slots 54, each of which accommodates one of the stringer blades 30. With reference to FIG. 6, it will be seen that the cutting edges 52 is coplanar with the stringer blade sharp cutting edges 32 and that the knife blade 50 is inclined in an inbound direction at a more aggressive angle, e.g., 30° than the inclined base plate portions 46, 48. A further crosscut sharp cutting edge 56 is formed at the leading edge of the aft base plate cutaway portion 48, as best seen in FIG. 2.

A planar tail blade 58 projects in an inboard direction from a mounting plate 60 which is secured to the aft base plate 36. The tail blade 58 lies in a plane parallel to the stringer blades 30. The tail blade 58 includes a first sharp cutting edge 62, which faces the fore base plate 34 and the incoming water flow, a second sharp cutting edge 64, which is obverse to the stringer blade cutting edges 32 and a third sharp cutting edge 66, which faces aft.

In accordance with the antifouling system 10 of the present invention, as water flows into the inlet 26 any water borne debris, such as seaweed and eel grass will be effectively crosscut shredded into small pieces which are incapable of fouling the jet drive 20 and impeller 22 and which will be harmlessly discharged through the outlet port 28. More specifically, the water borne debris will undergo an initial shredding, parallel to the incoming water flow direction, by the array of stringer blade sharp cutting edges 32 and crosscut shredding, transverse to the initial shredding by the crosscut sharp cutting edges 52 and the sharp cutting edge 56, formed at the leading edge of the aft base plate sloped cutaway portion 48. Additionally, the sharp cutting edges 62, 64 and 66 of the tail blade 58 are effective for shredding any residual debris tailings in the turbulent flow within the housing 24.

Thus it will be seen that there is provided an antifouling system for a water jet intake which achieves the aspects, features and considerations of the present invention and which is well suited to meet the conditions of practical usage.

In the Figures of this application, in some instances, a plurality of elements may be shown as illustrative of a particular element, and a single element may be shown as illustrative of a plurality of a particular elements. Showing a plurality of a particular element is not intended to imply that a system or method implemented in accordance with the invention must comprise more than one of that element or step, nor is it intended by illustrating a single element that the invention is limited to embodiments having only a single one of that respective element. Those skilled in the art will recognize that the numbers of a particular element shown in a drawing can, in at least some instances, be selected to accommodate the particular user needs.

The particular combinations of elements and features in the above-detailed embodiment are exemplary only; the interchanging and substitution of these teachings with other teachings in this and the incorporated-by-reference patents and applications are also expressly contemplated. As those skilled in the art will recognize, variations, modifications, and other implementations of what is described herein can occur to those of ordinary skill in the art without departing from the spirit and the scope of the invention as claimed.

Further, in describing the invention and in illustrating embodiments of the invention in the figures, specific terminology, numbers, dimensions, materials, etc., are used for the sake of clarity. However the invention is not limited to the specific terms, numbers, dimensions, materials. etc. so selected, and each specific term, number, dimension, material, etc., at least includes all technical and functional equivalents that operate in a similar manner to accomplish a similar purpose. Use of a given word, phrase, number, dimension, material, language terminology, product brand, etc. is intended to include all grammatical, literal, scientific, technical, and functional equivalents. The terminology used herein is for the purpose of description and not limitation.

All publications and references cited herein are expressly incorporated herein by reference in their entirety.

Having described the preferred embodiment of the invention, it will now become apparent to one of ordinary skill in the art that other embodiments incorporating their concepts may be used. Moreover, those of ordinary skill in the art will appreciate that the embodiment of the invention described herein can be modified to accommodate and/or comply with changes and improvements in the applicable technology and standards referred to herein. For example, the technology can be implemented in many other, different, forms, and in many different environments, and the technology disclosed herein can be used in combination with other technologies. Variations, modifications, and other implementations of what is described herein can occur to those of ordinary skill in the art without departing from the spirit and the scope of the invention as claimed. It is felt therefore that the embodiment should not be limited to disclosed embodiment but rather should be limited only by the spirit and scope of the appended claims.

The particular combinations of elements and features in the above-detailed embodiment are exemplary only; the interchanging and substitution of these teachings with other teachings in this and the referenced patents/applications are also expressly contemplated. As those skilled in the art will recognize, variations, modifications, and other implementations of what is described herein can occur to those of ordinary skill in the art without departing from the spirit and the scope of the invention as claimed. Accordingly, the foregoing description is by way of example only and is not intended as limiting. The invention's scope is defined in the following claims and the equivalents thereto.

Having thus described the invention, there is claimed as new and desired to be secured by Letters Patent:

1. A debris shredding water jet intake grate system, the system comprising a plurality of parallel planar stringer blades, a fore base plate and an aft base plate, one end of each stringer blade being mounted to the fore base plate and the other end of each stringer being mounted to the aft base plate, each stringer blade having a sharp cutting edge facing in an outboard direction when the grate system is mounted to a water jet intake, each stringer blade being of uniform thickness defined by parallel side walls extending in an inboard direction from the sharp cutting edge, whereby aquatic debris is shredded by the plurality of stringer blade sharp cutting edges when entering the water jet intake.

2. The debris shredding water jet intake grate system as constructed in accordance with claim 1 further including a crosscut knife blade having a sharp cutting edge extending transversely across the stringer blades, the crosscut knife blade including a plurality of slots, a stringer blade being seated in each slot, whereby the aquatic debris is shredded in a crosscut direction.

3. The debris shredding water jet intake grate system as constructed in accordance with claim 2 wherein the crosscut knife blade is sloped toward the fore base plate at an angle in the order of 30° whereby waterflow is directed through the intake.

4. The debris shredding water jet intake grate system as constructed in accordance with claim 1 wherein the aft base plate includes a leading edge facing the fore base plate, the leading edge comprising a sharp cutting edge, whereby the aquatic debris is shredded in a crosscut direction.

5. The debris shredding water jet intake grate system as constructed in accordance with claim 1 wherein the fore base plate and the aft base plate comprises a surface sloped in an inboard direction at an angle in the order of 15° whereby intake water flow is facilitated.

6. The debris shredding water jet intake grate system as constructed in accordance with claim 5 wherein the aft base plate includes a sharp cutting edge facing the fore base plate, the sharp cutting edge comprising an end of the surface sloped in an inboard direction, whereby the aquatic debris is shredded in a crosscut direction.

7. The debris shredding water jet intake grate system as constructed in accordance with claim 1 wherein one end of each stringer blade is welded to the fore base plate and the other end of each stringer blade is welded to the aft base plate.

8. An antifouling water jet intake grate system, the system comprising a plurality of parallel planar stringer blades, a fore base plate and an aft base plate, one end of each stringer blade being mounted to the fore base plate and the other end of each stringer being mounted to the aft base plate, each stringer blade having a sharp cutting edge facing in an outboard direction when the grate system is mounted to a water jet intake, the antifouling water jet intake grate system further including a tail blade lying in a plane parallel to the stringer blades and extending in an inboard direction from the aft base plate, the tail blade having a sharp cutting edge facing the fore base plate whereby aquatic debris is shredded by the stringer blade and tail blade sharp cutting edges when entering the water jet intake.

9. An antifouling water jet intake grate system as constructed in accordance with claim 8 wherein the tail blade includes a further sharp cutting edge facing inboard and an additional cutting edge facing aft.

10. An antifouling water jet intake grate system, the system comprising a plurality of parallel planar stringer blades, a fore base plate and an aft base plate, one end of each stringer blade being mounted to the fore base plate and the other end of each stringer being mounted to the aft base plate, each stringer blade having a sharp cutting edge facing in an outboard direction when the grate system is mounted to a water jet intake, the antifouling water jet intake grate system further including a replaceable cap plate secured over at least a portion of one of the base plates, the stringer blades and the base plates being formed of metal, the cap plate being formed of a different metal the different metal being susceptible to galvanic corrosion.

11. An antifouling water jet intake grate system as constructed in accordance with claim 10 wherein the replaceable cap plate is formed of zinc.

12. An antifouling water jet intake grate system, the system comprising a plurality of parallel planar stringer blades, each stringer blade having a sharp cutting edge facing in an outboard direction when the grate system is mounted to a water jet intake, each stringer blade being of uniform thickness in an inboard direction from the sharp cutting edge, the antifouling water jet intake grate system further including a crosscut blade extending transversely across the stringer blades, the crosscut blade having at least one sharp cutting edge, whereby aquatic debris is shredded along transverse planes.

13. An antifouling water jet intake grate system as constructed in accordance with claim 12 wherein the stringer blade sharp cutting edge and the crosscut blade sharp cutting edge are coplanar.

14. An antifouling water jet intake grate system as constructed in accordance with claim 12 further including a fore base plate and an aft base plate, one end of each stringer being mounted to the fore base plate and the other end of each stringer blade being mounted to the aft base plate.

15. An antifouling water jet intake grate system as constructed in accordance with claim 12 wherein 1 whereby waterflow is directed through the intake.

16. An antifouling water jet intake grate system as constructed in accordance with claim 12 further including a tail blade lying in a plane parallel to the stringer blades and extending in an inboard direction from the aft base plate, the tail blade having a cutting edge facing the fore base plate.

17. A method of precluding a water jet intake and an impeller of a jet drive system from fouling due to aquatic debris, the method comprising the steps of:

a) providing a plurality of parallel stringer blades each having a sharp cutting edge, b) mounting the stringer blades over an intake of a water jet drive with the sharp cutting edges facing in an outboard direction, and c) actuating the impeller to draw water and aquatic debris into the intake and shredding the aquatic debris into small pieces by drawing the aquatic debris past the sharp cutting edges.

18. A method of precluding a water jet intake grate and an impeller of a jet drive system from fouling due to aquatic debris in accordance with claim 17, wherein step a) further includes;

i) extending a crosscut knife blade having a sharp cutting edge transversely across the stringer blades, whereby the aquatic debris is shredded in a crosscut direction.

19. A method of precluding a water jet intake grate and an impeller of a jet drive system from fouling due to aquatic debris in accordance with claim 17 wherein one end of each stringer blade is mounted to a fore base plate and the other end of each stringer blade is mounted to an aft base plate and step b) includes securing the fore base plate and the aft base plate to portions of the hull of a watercraft adjacent the intake.

20. A method of precluding a water jet intake grate and an impeller of a jet drive system from fouling due to aquatic debris in accordance with claim 19 further including the step of reducing turbulence in water flow into the intake by providing the fore base plate and the aft base plate with surfaces sloped in an inboard direction at an angle in the order of 15°.

* * * * *